US008573707B2

(12) United States Patent
Swope

(10) Patent No.: US 8,573,707 B2
(45) Date of Patent: Nov. 5, 2013

(54) RETAINER SLEEVE AND WASHER FOR CUTTING TOOL

(75) Inventor: Chad A. Swope, Bedford, PA (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 13/525,618

(22) Filed: Jun. 18, 2012

(65) Prior Publication Data

US 2012/0319454 A1 Dec. 20, 2012

Related U.S. Application Data

(60) Provisional application No. 61/498,771, filed on Jun. 20, 2011.

(51) Int. Cl.
*E21C 35/197* (2006.01)

(52) U.S. Cl.
USPC ..... 299/104

(58) Field of Classification Search
USPC ..... 299/79.1, 102–104, 106–107, 110
See application file for complete search history.

(56) References Cited

U.S. PATENT DOCUMENTS

| | | | | |
|---|---|---|---|---|
| 4,632,463 | A * | 12/1986 | Sterwerf, Jr. | 299/104 |
| 5,374,111 | A * | 12/1994 | Den Besten et al. | 299/106 |
| 5,931,542 | A * | 8/1999 | Britzke et al. | 299/104 |
| 6,176,552 | B1 * | 1/2001 | Topka et al. | 299/104 |
| 8,061,783 | B2 | 11/2011 | Keller et al. | |
| 2006/0125308 | A1 * | 6/2006 | Sollami | 299/107 |
| 2007/0152495 | A1 * | 7/2007 | Sollami | 299/107 |

* cited by examiner

*Primary Examiner* — Sunil Singh
(74) *Attorney, Agent, or Firm* — Matthew W. Smith, Esq.

(57) ABSTRACT

An apparatus for mounting a cutting tool includes a retainer sleeve that defines at least one retention groove adjacent an axial forward end thereof and a washer removably attached to the retainer sleeve. The washer has a forward surface, a rearward surface and an interior surface that define a central opening, wherein the interior surface includes at least one protrusion extending inward into the central opening that is structured and arranged for cooperating with the at least one retention groove in the retainer sleeve. The retainer sleeve further defines a longitudinal slot that extends from an axial forward end to an axial rearward end of the retainer sleeve. The washer further includes a key extending inward into the central opening that is structured and arranged for cooperating with the longitudinal slot in the retainer sleeve.

11 Claims, 5 Drawing Sheets

RETAINER SLEEVE AND WASHER FOR CUTTING TOOL

CROSS-REFERENCE TO RELATED APPLICATIONS

This application claims the benefit of U.S. Provisional Application No. 61/498,771 filed Jun. 20, 2011, which is hereby fully incorporated by reference.

BACKGROUND OF THE INVENTION

The present invention relates to cutting tools and cutting tool assemblies used for mining and construction and, more particularly, relates to a retainer sleeve and washer component for such cutting tools and cutting tool assemblies.

Rotatable cutting tools are used in conjunction with a machine used to break up (or cut) a substrate such as coal, rock, asphalt pavement, asphaltic concrete, concrete or the like. In its very basic aspects, such a machine includes a driven member (e.g., a chain, a wheel or a drum), a holder either directly or indirectly mounted to the driven member, and a rotatable cutting tool rotatably held in the holder. It is the cutting tool that impinges the substrate so as to break it into pieces upon impact.

As known to those skilled in the art, the useful life of the holder is much longer than the useful life of the cutting tool. A holder is often referred to as a part of a block. Accordingly, the term "holder" refers herein to a portion of a block or a block which holds a cutting bit. Each block is intended to accommodate many changes of cutting tools before the block must be changed. In order to reduce the wear on the forward face of the block and fretting between the block and the cutting bit, a retention wear sleeve may be used in conjunction with cutting tool and holder. The retention wear sleeve generally has a forward portion and shank and is positioned between the cutting tool and holder. The retention wear sleeve protects the block from wear and is removably mounted in the holder. However, it has been found that after use it often becomes difficult to remove the retention wear sleeve from the holder. Furthermore, if the cutting tool breaks or fractures during operation then it becomes even more difficult to remove the retention wear sleeve.

Accordingly, it will be appreciated that improved cutting tool assemblies and/or related components, e.g. retention wear sleeves, that overcome limitations, shortcomings and disadvantages of known cutting tool assemblies and/or related components would be desirable.

SUMMARY OF THE INVENTION

In accordance with an aspect of the invention, a tool assembly for mounting a cutting tool includes a block comprising a holder portion having a front face, a rear face and a longitudinal bore extending therethrough from the front face to the rear face. The tool assembly also includes a retainer sleeve removably received in the bore of the holder, the retainer sleeve defining a longitudinal slot that extends from an axial forward end to an axial rearward end of the retainer sleeve, the retainer sleeve further defining at least one retention groove adjacent the axial forward end thereof. The tool assembly further includes a washer removably attached to the retainer sleeve, the washer having a forward surface, a rearward surface and an interior surface that define a central opening. The interior surface of the washer includes: a key extending inward into the central opening that is structured and arranged for cooperating with the longitudinal slot in the retainer sleeve; and at least one protrusion extending inward into the central opening that is structured and arranged for cooperating with the at least one retention groove in the retainer sleeve. In addition, the rearward surface of the washer may include at least one removal notch.

In accordance with another aspect of the invention, an apparatus for mounting a cutting tool includes a sleeve defining a slot that extends from an axial forward end to an axial rearward end of the sleeve and a washer removably attached to the sleeve, the washer having a forward surface, a rearward surface and an interior surface that define a central opening, wherein the interior surface includes a key extending inward into the central opening that is structured and arranged for cooperating with the slot in the sleeve.

In accordance with yet another aspect of the invention, an apparatus for mounting a cutting tool includes a retainer sleeve having an axial forward end and an axial rearward end, the retainer sleeve defining at least one retention groove adjacent the axial forward end thereof. The apparatus also includes a washer removably attached to the retainer sleeve, the washer having a forward surface, a rearward surface and an interior surface that define a central opening, wherein the interior surface includes at least one protrusion extending inward into the central opening that is structured and arranged for cooperating with the at least one retention groove in the retainer sleeve.

These and other aspects of the present invention will be more fully understood following a review of this specification and drawings.

DETAILED DESCRIPTION

Figure 1:
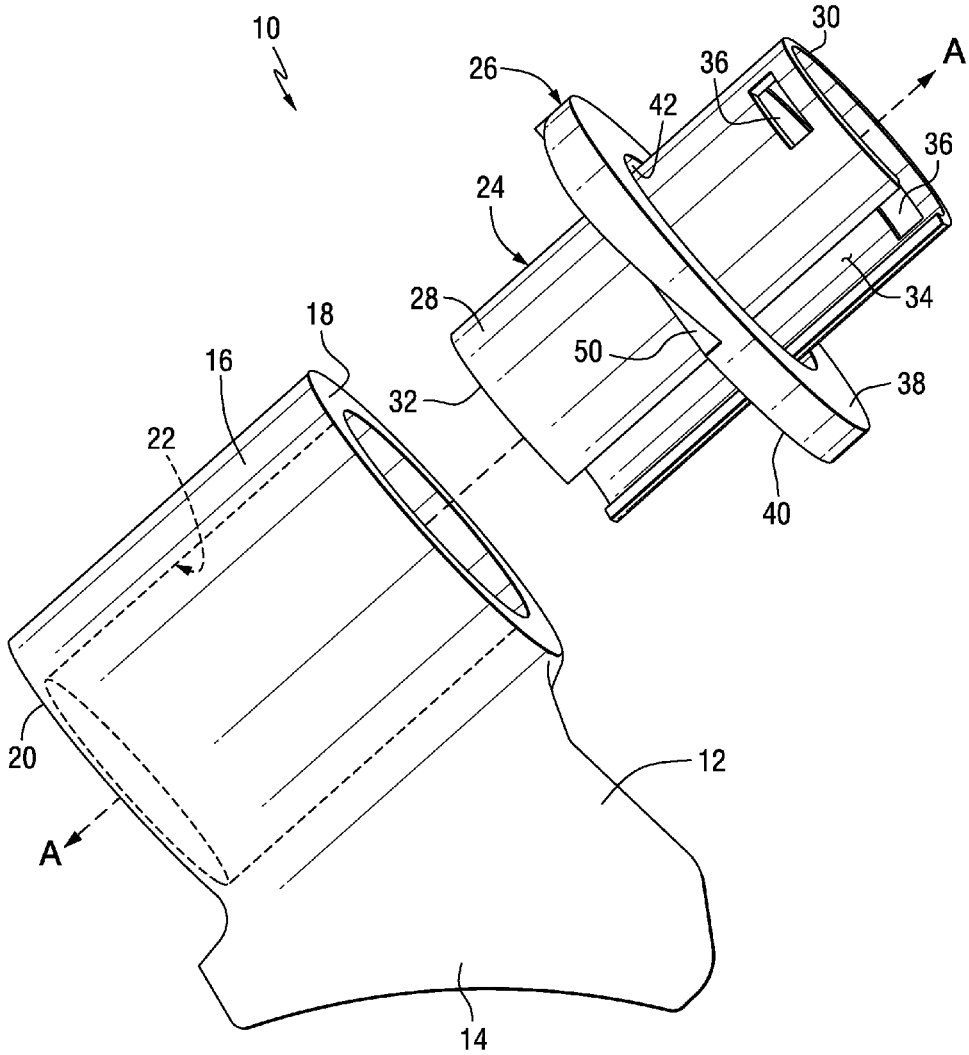
FIG. 1 is an exploded isometric view of a tool assembly, in accordance with an aspect of the invention.

Referring now to FIG. 1, a tool assembly 10 is shown. The tool assembly 10 includes a block 12 which mounts onto a rotating drum or other piece of equipment (not shown). The block 12 will often include a pedestal portion 14 and holder portion 16. The pedestal portion 14 is configured to allow the block 12 to be attached to the drum or other piece of equipment. In one example, the pedestal portion 14 has a curved bottom congruent to the shape of a drum exterior. The congruent shape allows the pedestal portion 14 to be easily welded onto the drum. The holder portion 16 includes a front face 18 and a rear face 20. The holder portion 16 portion of the block 12 has a longitudinal bore 22 extending between the front face 18 and the rear face 20. The bore 22 is structured and arranged to removably receive a retainer sleeve 24 (which also may be referred to as a wear sleeve or the like) that is inserted into the holder portion 16. A washer 26 is structured and arranged to be removably attached to the retainer sleeve 24. In one aspect, the washer 26 is circumferentially disposed about an outer surface 28 of the retainer sleeve 24. The bore 22, retainer sleeve 24 and washer 26 are generally disposed about a central longitudinal axis A-A. In one aspect, the tool assembly 10 is structured and arranged for mounting a cutting tool (not shown) such as, for example, a conical cutting tool.

Figure 2:
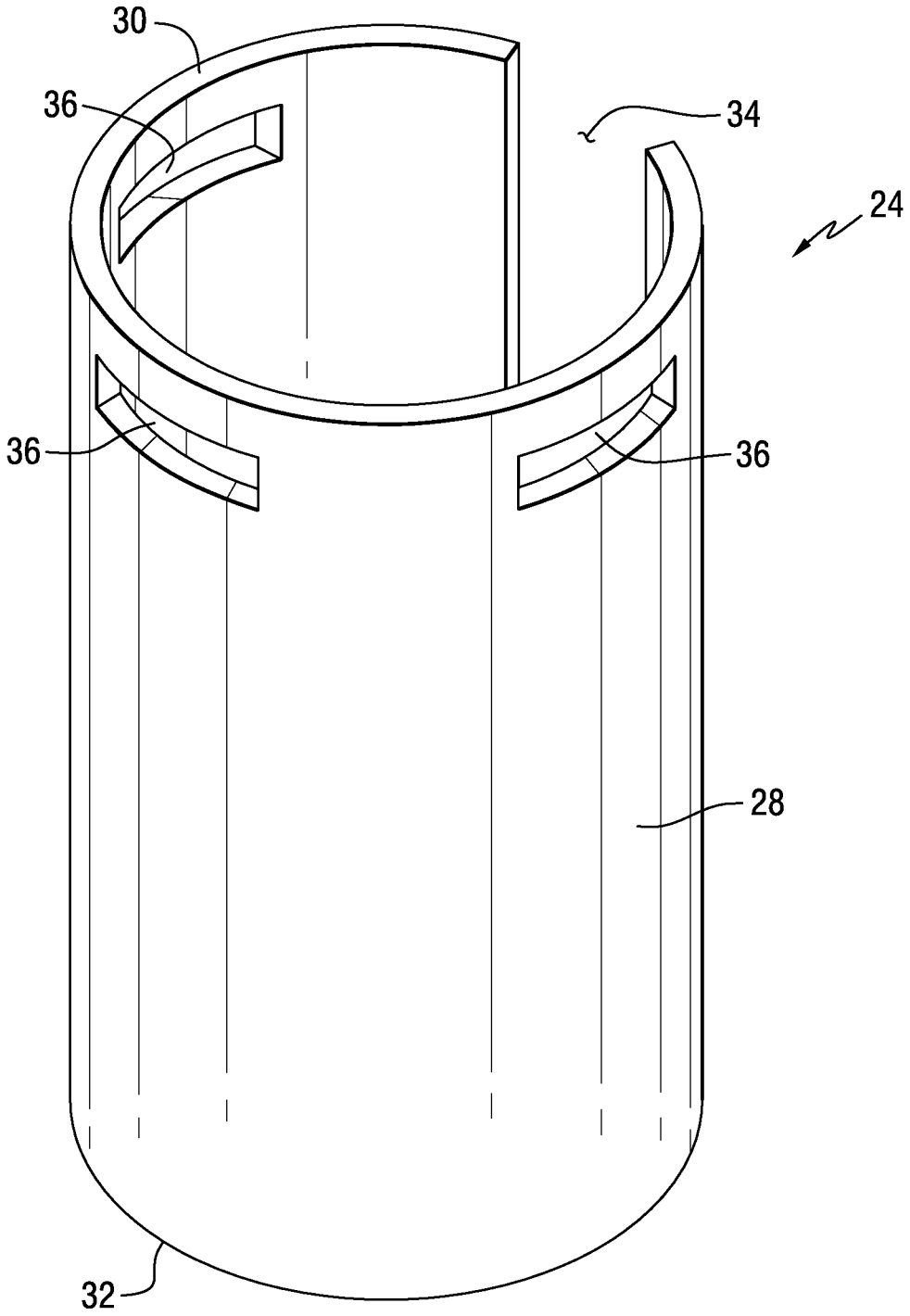
FIG. 2 is an isometric view of a retainer sleeve, in accordance with an aspect of the invention.
Figure 3:
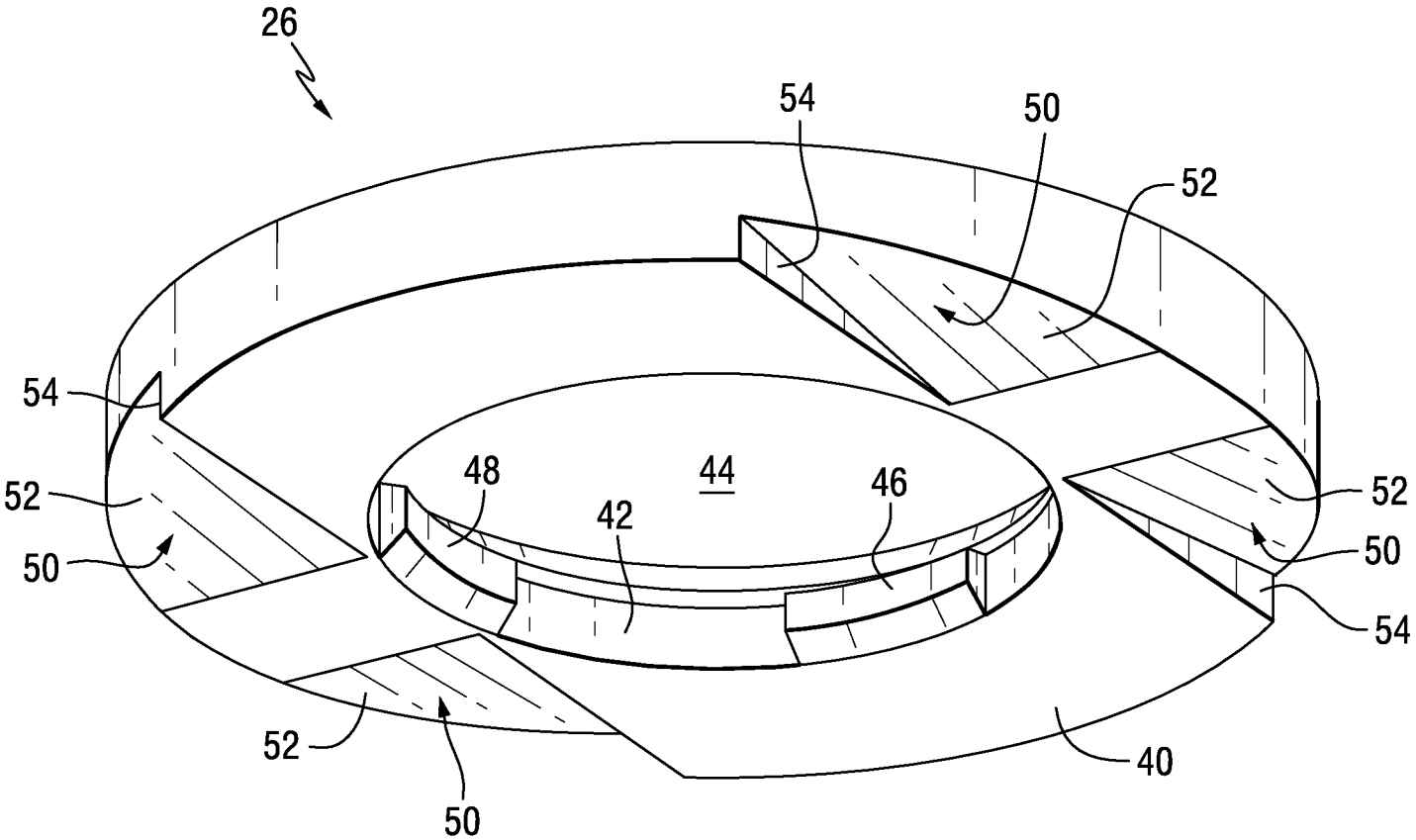
FIG. 3 is a bottom isometric view of a washer, in accordance with an aspect of the invention.
Figure 4:
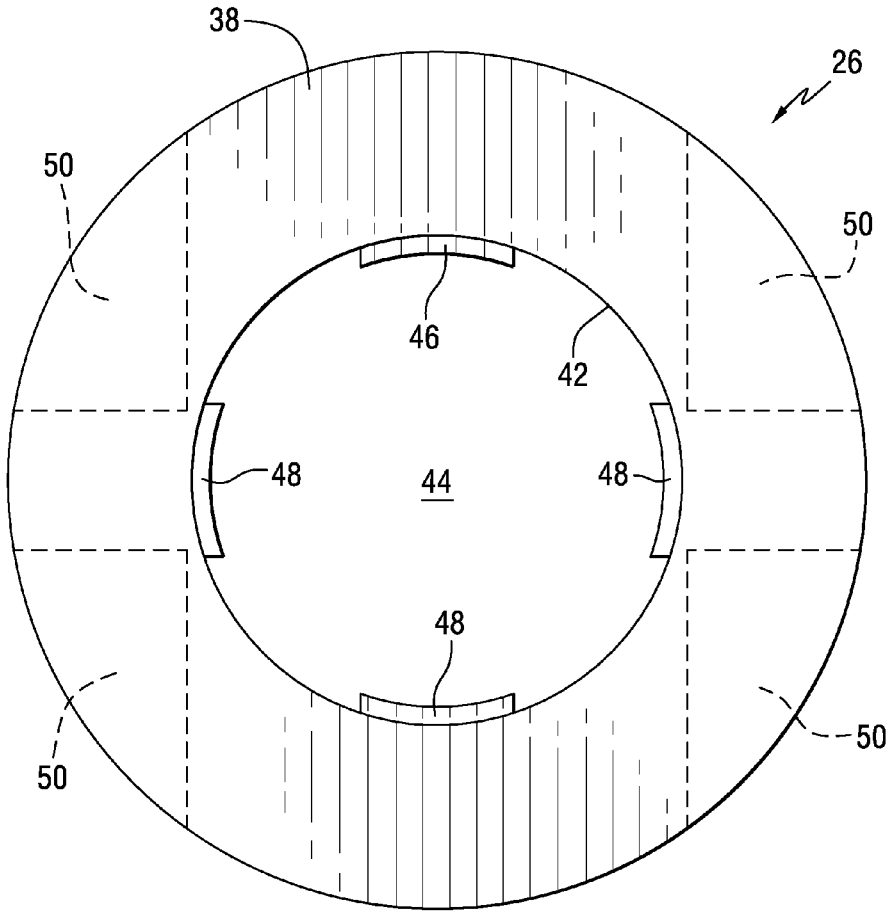
FIG. 4 is a top plan view of the washer illustrated in FIG. 3, in accordance with an aspect of the invention.
Figure 5:
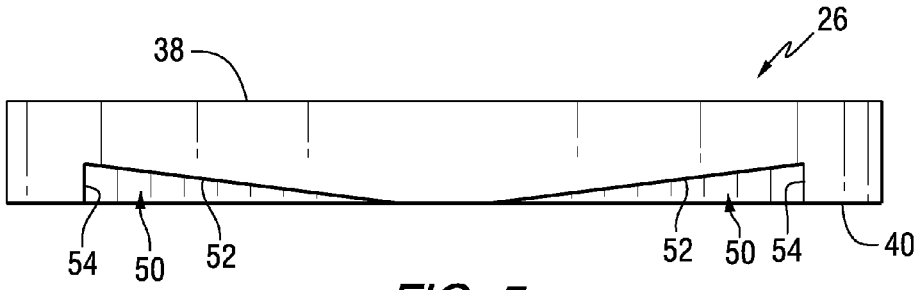
FIG. 5 is a side elevational view of the washer illustrated in FIG. 3, in accordance with an aspect of the invention.

Referring to FIGS. 1 and 2, the retainer sleeve 24 has an axial forward end 30 and an axial rearward end 32. The retainer sleeve 24 includes or defines a longitudinal slot 34. In one aspect, the slot 34 extends from the axial forward end 30 to the axial rearward end 32 of the sleeve 24. The retainer sleeve 24 further includes or defines at least one retention groove 36. In one example, the sleeve 24 includes three retention grooves 36 spaced apart about the periphery of the sleeve 24. In one aspect, the retention grooves 36 are formed or positioned adjacent the axial forward end 30 of the sleeve 24.

Referring to FIGS. 1 and 3-5, the washer 26 for removably attaching to the retainer sleeve 24 includes a forward surface 38, a rearward surface 40 and an interior surface 42. The interior surface defines a central opening 44. The interior surface 42 includes a key 46 extending inward into the central opening 44 that is structured and arranged for cooperating with the longitudinal slot 34 in the retainer sleeve 24. The interior surface 42 also includes at least one protrusion 48 extending inward into the central opening 44 that is structured and arranged for cooperating with the at least one retention groove 36 in the retainer sleeve 24. In one example, there are three protrusions 48 spaced apart about the periphery of the interior surface 42.

In one aspect, the key 46 and the protrusions 48 are similarly sized and have similar shapes/configurations such that they are interchangeable, i.e. any of the protrusions 48 could serve as the key 46 or the key 46 could serve as one of the protrusions 48. In another aspect, the key 46 and the protrusions 48 are the same size and have the same shape/configuration such that they are interchangeable.

Figure 6:
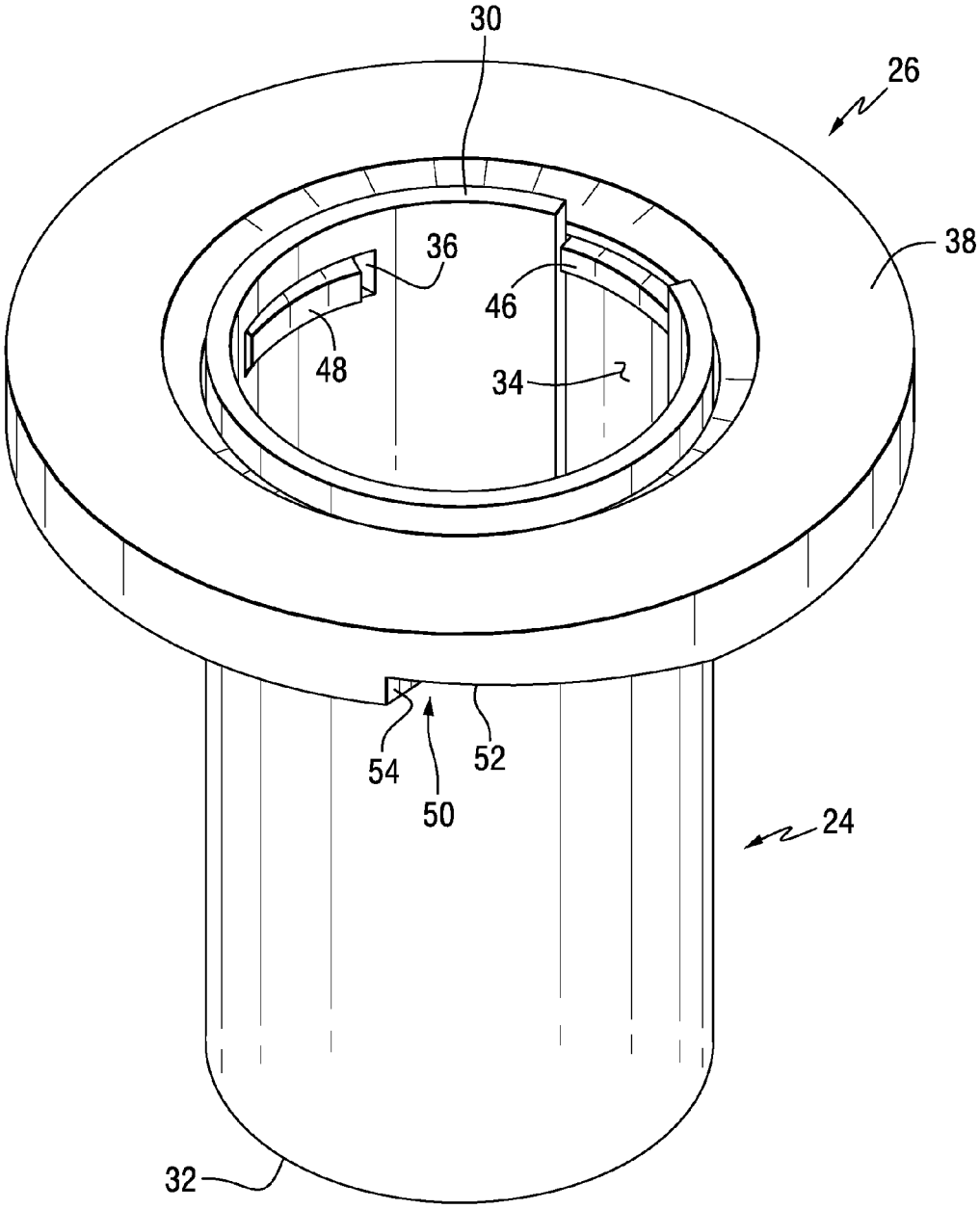
FIG. 6 is an isometric view of the retainer sleeve and washer as assembled, in accordance with an aspect of the invention.

Referring to FIG. 1, assembly includes the axial rearward end 32 of the retainer sleeve 24 being passed through the central opening 44 of the washer 26 such that the key 46 is aligned with and received in the longitudinal slot 34. Initially, the washer 26 is moved at least part way along the length of the sleeve 24 (as shown, for example, in FIG. 1). Then, the axial rearward end of the sleeve 24 is placed into the bore 22 of the holder portion 16. As the sleeve 24 continues to move into the bore 22, eventually the rearward surface 40 of the washer 26 will contact or engage the front face 18 of the holder portion 16. Then, as the sleeve 24 continues to move further into the bore 22 the contact between the washer 26 and the front face 18 of the holder portion 16 causes the washer 26 to move toward the axial forward end 30 of the retainer sleeve 24 until the protrusions 48 on the washer 26 reach the retention grooves 36 of the sleeve 24. The sleeve 24 is structured and arranged such that it has sufficient flexibility and/or resiliency to allow the sleeve 24 to spring radially outward to capture and secure the protrusions 48 in the retention grooves 36. FIG. 6 illustrates the retainer sleeve 24 and washer 26 in an assembled position and shows one of the protrusions 48 as received in one of the retention grooves 36. FIG. 6 also illustrates the key 46 as received in the slot 34 of the sleeve 24.

Once the retainer sleeve 24 and the washer are assembled and fully received in the bore 22 of the holder portion 16, it will be appreciated that the described cooperation of the key 46 and the longitudinal slot 34 prevents rotation of the washer 26 with respect to the retainer sleeve 24. In other words, the washer 26 will only rotate if the sleeve 24 is rotated and vice-versa. In addition, it will be appreciated that the described cooperation of the protrusion(s) 48 and the groove (s) 36 secures the washer 26 in position adjacent the axial forward end 30 of the retainer sleeve 24. The sleeve 24 and washer 26 can then only move vertically or longitudinally along axis A-A together as a single unit. Advantageously, the retainer sleeve 24 is structured and arranged to protect the bore 22 of the holder portion 16 from wear and the washer 26 is structured and arranged to protect the front face 18 of the holder portion 16 from wear such that the sleeve 24 and washer 26 cooperate to increase the useful life of the block 12.

In another aspect of the invention, the washer 26 includes at least one puller or removal notch 50 formed in the rearward surface 40 (see, for example, FIGS. 1 and 3-6). Once assembled, the removal notch 50 is spaced apart from the front face 18 of the holder portion 16. In one aspect, the removal notch 50 includes a sloped or inclined surface 52 and an end wall 54. In one example, the washer 26 includes four removal notches spaced apart about the rearward surface 40. Each removal notch 50 is structured and arranged so as to provide access or clearance for a prying tool (not shown) to be positioned between the block 12 and the washer 26. The prying tool can be used to remove a worn washer 26 and sleeve 24 from the block 12.

Whereas particular aspects of this invention have been described above for purposes of illustration, it will be evident to those skilled in the art that numerous variations of the details of the present invention may be made without departing from the invention. For example, the invention may include means for preventing rotation of the retainer sleeve 24 within the bore 22, i.e. a non-rotating retainer sleeve, while still providing for a rotatable cutting tool to be received in the retainer sleeve 24.

The invention claimed is:

1. A tool assembly for mounting a cutting tool, the tool assembly comprising:
- a block comprising a holder portion having a front face, a rear face and a longitudinal bore extending therethrough from the front face to the rear face, the longitudinal bore disposed about a central longitudinal axis;
- a retainer sleeve removably received in the bore of the holder and disposed about the central longitudinal axis, the retainer sleeve defining a longitudinal slot that extends from an axial forward end to an axial rearward end of the retainer sleeve, the retainer sleeve further defining at least one retention groove adjacent the axial forward end thereof wherein the at least one retention groove is enclosed on all sides; and
- a washer disposed about the central longitudinal axis and removably attached to the retainer sleeve, the washer having a forward surface, a rearward surface and an interior surface that define a central opening, wherein the interior surface includes:
  - a key extending inward into the central opening that is structured and arranged for cooperating with the longitudinal slot in the retainer sleeve; and
  - at least one protrusion extending inward into the central opening that is structured and arranged for cooperating with the at least one retention groove in the retainer sleeve, wherein the cooperation of the at least one protrusion and the at least one retention groove secures the washer in position adjacent the axial forward end of the retainer sleeve and prevents longitudinal movement of the washer with respect to the retainer sleeve in both axial forward and axial rearward directions along the central longitudinal axis.

2. The tool assembly of claim 1, wherein the rearward surface of the washer engages the front face of the holder portion.

3. The tool assembly of claim 2, wherein the rearward surface of the washer includes at least one removal notch.

4. The tool assembly of claim 3, wherein the at least one removal notch is spaced apart from the front face of the holder portion.

5. The tool assembly of claim 1, wherein the cooperation of the key and the longitudinal slot prevents rotation of the washer with respect to the retainer sleeve.

6. An apparatus for mounting a cutting tool, the apparatus comprising:

a retainer sleeve disposed about a central longitudinal axis and having an axial forward end and an axial rearward end, the retainer sleeve defining at least one retention groove adjacent the axial forward end thereof wherein the at least one retention wove is enclosed on all sides; and a washer disposed about the central longitudinal axis and removably attached to the retainer sleeve, the washer having a forward surface, a rearward surface and an interior surface that define a central opening, wherein the interior surface includes at least one protrusion extending inward into the central opening that is structured and arranged for cooperating with the at least one retention groove in the retainer sleeve, wherein the cooperation of the at least one protrusion and the at least one retention groove secures the washer in position adjacent the axial forward end of the retainer sleeve and prevents longitudinal movement of the washer with respect to the retainer sleeve in both axial forward and axial rearward directions along the central longitudinal axis.

7. The apparatus of claim 6, wherein the retainer sleeve further defines a longitudinal slot that extends from an axial forward end to an axial rearward end of the retainer, sleeve.

8. The apparatus of claim 7, wherein the washer further includes a key extending inward into the central opening that is structured and arranged for cooperating with the longitudinal slot in the retainer sleeve.

9. The apparatus of claim 8, wherein the cooperation of the key and the longitudinal slot prevents rotation of the washer with respect to the retainer sleeve.

10. The apparatus of claim 6, wherein the rearward surface of the washer includes at least one removal notch.

11. The apparatus of claim 6, wherein the washer is circumferentially disposed about an outer surface of the retainer sleeve.

* * * * *